US005964377A

United States Patent [19]

Demarest et al.

[11] Patent Number: 5,964,377

[45] Date of Patent: Oct. 12, 1999

[54] MANUALLY OPERABLE PUMP FOR MIXING AND DISPENSING PRIMARY AND SECONDARY FLUIDS

[75] Inventors: Scott W. Demarest; James R. Crapser, both of Caledonia; Allen D. Miller, Racine; Robert E. Corba, Caledonia; Imre J. Dancs, Greenfield; David J. Houser, Racine, all of Wis.

[73] Assignee: S. C. Johnson & Son, Inc., Racine, Wis.

[21] Appl. No.: 08/950,342

[22] Filed: Oct. 14, 1997

[51] Int. Cl.[6] ..... B67D 5/52

[52] U.S. Cl. ..... 222/136; 222/145.5; 222/383.1

[58] Field of Search ..... 222/136, 383.1, 222/145.5, 145.7, 325, 256

[56] References Cited

U.S. PATENT DOCUMENTS

| | | |
|---|---|---|
| 613,222 | 10/1898 | Blackman . |
| 2,006,437 | 7/1935 | Burgess et al. . |
| 2,557,120 | 6/1951 | Knoblock . |
| 3,760,986 | 9/1973 | Castner et al. . |
| 3,786,963 | 1/1974 | Metzler, III . |
| 4,355,739 | 10/1982 | Vierkotter . |
| 4,692,103 | 9/1987 | Anderson . |
| 4,826,048 | 5/1989 | Skorka et al. . |
| 4,902,281 | 2/1990 | Avoy . |
| 4,949,874 | 8/1990 | Fiedler et al. . |
| 4,969,579 | 11/1990 | Behar ..... 222/136 |
| 4,979,646 | 12/1990 | Andris . |
| 5,009,342 | 4/1991 | Lawrence et al. . |
| 5,056,685 | 10/1991 | Wild . |
| 5,152,461 | 10/1992 | Proctor . |
| 5,156,299 | 10/1992 | De Caluwe . |
| 5,169,029 | 12/1992 | Behar et al. . |
| 5,332,157 | 7/1994 | Proctor . |
| 5,337,921 | 8/1994 | Wilson et al. . |
| 5,339,990 | 8/1994 | Wilder . |
| 5,385,270 | 1/1995 | Cataneo et al. . |
| 5,398,846 | 3/1995 | Corba et al. . |
| 5,402,916 | 4/1995 | Nottingham . |
| 5,439,141 | 8/1995 | Clark et al. . |
| 5,472,119 | 12/1995 | Park et al. . |
| 5,535,950 | 7/1996 | Barriac et al. . |
| 5,560,545 | 10/1996 | Downey et al. . |
| 5,562,250 | 10/1996 | O'Neill . |
| 5,609,299 | 3/1997 | Foster et al. . |
| 5,626,259 | 5/1997 | Maas et al. . |

FOREIGN PATENT DOCUMENTS

| | | |
|---|---|---|
| 410858 | 1/1991 | European Pat. Off. . |
| 2310149 | 8/1997 | United Kingdom . |
| PCT/US94/07156 | 1/1995 | WIPO . |
| PCT/US95/15734 | 6/1996 | WIPO . |
| PCT/US96/10015 | 8/1996 | WIPO . |

OTHER PUBLICATIONS

PCT Gazette 33/1997/WO 97/269998.
PCT Gazette 33/1997/WO 97/27947.
PCT Gazette 33/1997/WO 97/26997.
Advertising brochure on Pump Type Cartridge Pack.
Wanbaugh and DiMaggio U.S. Pat. Appln. Serial No. 08/728,793 filed Oct. 10, 1996.

*Primary Examiner*—Gregory L. Huson

[57] ABSTRACT

A manually operable dispensing pump for use with a primary container containing a primary fluid, the pump having a body containing a sprayer mechanism and having a primary attachment means for attaching to the primary container and secondary attachment means for attaching to a secondary container having contents to be co-dispensed with the primary fluid. The secondary container is attachable by the secondary attachment means directly to the body at a location remote from the primary container. The secondary container has a holding chamber for holding selected contents and an outlet that provides immediate communication between the holding chamber and the sprayer mechanism when the secondary container is attached to the body so that contents of the secondary container can pass immediately into a mixing chamber in the body to be mixed with primary fluid pumped from the primary container. The mixing chamber contents are then discharged from the pump. Preferably, the secondary container is detachable. A detachable secondary container to be used with the pump is also disclosed.

34 Claims, 8 Drawing Sheets

MANUALLY OPERABLE PUMP FOR MIXING AND DISPENSING PRIMARY AND SECONDARY FLUIDS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to a manually operated dispensing pump for mixing and simultaneously delivering two separate materials, preferably two fluids. In particular, the invention relates to such a dispensing pump in which the proportions of a first fluid to a second material to be dispensed are such that a relatively large amount of the first fluid is mixed with a relatively small amount of the second material. Commonly, the second material is a concentrate, active ingredient, or activating substance that is mixed in relatively small quantities with the first fluid, which may be a liquid diluant, carrier, or substance requiring activation just prior to use.

The art relating to manually activated pumps for spraying two liquids simultaneously is crowded. Commonly, as in Park and Corba, U.S. Pat. No. 5,472,119, the pumps are intended to be used with dual bottles of very similar construction. See also Cataneo et al., U.S. Pat. No. 5,385,270; Lawrence et al., U.S. Pat. No. 5,009,342; Avoy, U.S. Pat. No. 4,902,281; Skorka et al., U.S. Pat. No. 4,826,048; Castner et al., U.S. Pat. No. 3,760,986; Proctor, U.S. Pat. No. 5,332,157; Wilder, U.S. Pat. No. 5,339,990; and Fiedler et al., U.S. Pat. No. 4,949,874. The disclosures of these patents and of all other publications referred to herein are incorporated by reference as if fully set forth herein.

Some of the prior art devices employ entirely separate and parallel pumping systems, one for each liquid container, with the output of the pumping systems being mixed at or just prior to a nozzle (see Skorka et al. and Barriac et al., U.S. Pat. No. 5,535,950 at FIG. 9, as examples). Other art employs separate dip tubes or other liquid transfer means, each drawing from separate bottles, with the liquids to be dispensed drawn by a single piston to a mixing chamber prior to entering the piston for ultimate expulsion through a nozzle. See, for example, Maas et al., U.S. Pat. No. 5,626,259; Cataneo et al., U.S. Pat. No. 5,385,270; Lawrence et al., U.S. Pat. No. 5,009,342; and Park et al., U.S. Pat. No. 5,472,119.

Procter, U.S. Pat. No. 5,332,157, shows a cylinder and piston device in which liquid is led via liquid transfer means to valved openings in the face of a piston. The head room within the cylinder above the piston serves as a mixing chamber. Similarly, O'Neill, U.S. Pat. No. 5,562,250, shows a single cylinder and piston arrangement, with the space in the cylinder above the piston serving as a mixing chamber. In O'Neill, dip tubes descending to the compartments of a multiple-compartment container communicate directly with openings in the cylinder.

The relative amounts of liquid pumped from different compartments is controlled most commonly by constricting or selecting the relative sizes of the liquid flow paths at some point between the containers and the place where they are mixed before being dispensed. See O'Neill, U.S. Pat. No. 5,562,250, Vierkötter, U.S. Pat. No. 4,355,739, Metzler, III, U.S. Pat. No. 3,786,963, among others.

Devices with dual pump cylinders, such as Barriac et al., U.S. Pat. No. 5,535,950, clearly could achieve relative metering of materials by selection of the relative displacement volumes of each of the two pumping mechanisms. A device acknowledged to be prior art and believed to be assigned to Calmar, Inc., of City of Industry, Calif., employs two, separate pistons of differing sizes. The smaller piston is directly mounted as an axial extension of the larger piston, with valving such that the small piston always draws liquid from the container attached to it in an amount that is in a fixed relation to that drawn by the larger piston from the container attached to the larger piston. The liquid drawn into the smaller piston via a dip tube communicating with a secondary container is discharged directly into the head space above the larger piston, which serves as a mixing chamber.

Several important matters are not well addressed by the art. For example, especially if a secondary container's contents are a concentrate, dip tubes and other extensive fluid transfer means may require that inconvenient amounts of the concentrate be expended simply to prime the pump or otherwise fill the system. The art does not provide a manually operated dispensing pump designed to pump fluid from a primary container and combine it with contents drawn from a secondary container where the secondary container's contents are delivered to a mixing chamber without having to pass through an intervening dip tube or comparable, extensive fluid transfer means.

Furthermore, the art does not show such a device that also provides for the convenient replacement of one secondary container by another secondary container, without disturbing the primary container. A replaceable secondary container would allow convenient recharging of the device or the exchange of one secondary ingredient for another.

In addition, much of the art shows multiple containers to be either grouped as subdivided parts of a unitarily formed bottle or to be a smaller reservoir inserted within a larger bottle. In the latter arrangement, the smaller reservoir is bathed on its outside by the liquid contained by the larger bottle while it holds on its inside its own contents, and the former arrangement requires at least a common wall. In either case, the second reservoir must be made of a material that can successfully contain one of the two materials to be co-dispensed while it can also resist infiltration by the other material.

However, one of the advantages of dual dispensing is the opportunity to dispense essentially incompatible materials that are mixed in the dispensing pump and immediately applied. Such incompatible materials may well have different containment requirements, making it desirable that the two reservoirs be held physically separate from each other. The art provides no convenient means for providing for such separation without the need for dip tubes or other extensive fluid transfer means for each reservoir.

BRIEF SUMMARY OF THE INVENTION

The invention provides a manually operable dispensing pump for use with a primary container containing a primary fluid and a secondary container having contents to be co-dispensed with the primary fluid. The dispensing pump has a body that has primary attachment means to attach the body to the primary container and secondary attachment means to which the secondary container can be attached.

The dispensing pump includes a sprayer mechanism held by or formed within the body. The sprayer mechanism includes a piston and cylinder having cylinder head space above the piston. A mixing chamber is provided that is in fluid communication with the cylinder head space. The sprayer mechanism also includes a dip tube or other primary fluid transfer means for transferring fluid to the mixing chamber from the primary container. The primary fluid transfer means includes a primary check valve that allows fluid being transferred therein to flow only toward and not away from the mixing chamber.

The sprayer mechanism also includes a finger operated trigger or other manual operating means for reciprocatingly moving the piston within the cylinder, alternatingly increasing and decreasing the cylinder head space to draw contents into and then expel the contents from the mixing chamber. The cylinder head space can itself serve as the mixing chamber, although a separate chamber simply in fluid communication with the cylinder head space can also serve as the mixing chamber, either by itself or in combination with the cylinder head space.

The sprayer mechanism also includes a discharge orifice and a discharge conduit that provides fluid communication between the mixing chamber and the discharge orifice. The discharge conduit has a discharge check valve that permits fluid to move in the discharge conduit only toward the discharge orifice and not back toward the mixing chamber.

The dispensing pump of the invention further includes a secondary container that is attachable directly to the body by the secondary attachment means at a location remote from the primary attachment means. The secondary container includes a holding chamber holding selected contents and an outlet that provides immediate communication between the holding chamber and the sprayer mechanism when the secondary container is attached to the body.

The attachment of the secondary container to the body is achieved in such a manner that contents of the secondary container can pass immediately into the mixing chamber. Contents will be understood to be able to pass immediately from the secondary container into the mixing chamber if the contents are not required to pass through a dip tube or other structure not forming a part of or contained within the body of the dispensing pump. A secondary check valve permits contents of the secondary holding chamber to move only toward and not away from the mixing chamber. The secondary check valve may be either part of the sprayer mechanism or part of the secondary container. Depending on the requirements of the particular design of the pump, the secondary check valve may be a ball valve, umbrella valve, flapper valve, duck-bill valve, or any other one-way valve of the many kinds well known to those skilled in the art.

As a consequence of the structure disclosed above, when a user moves the piston by use of the manual operating means, contents of the secondary container and fluid from the primary container both first are drawn into the mixing chamber, where they intermingle. They then are expelled through the discharge orifice via the discharge conduit.

It will be noted that this mixed discharge is achieved by a dispensing pump that holds the secondary container separate from the primary container, with no part of the device being required to contain or otherwise interact with both of the materials to be dispensed until they reach the mixing chamber. Furthermore, the fact that contents of the secondary container can pass immediately into the mixing chamber avoids the use of dip tubes or other extensive fluid communication arrangements for the secondary container, reducing the amount of secondary container contents that must be available simply to prime the pump or otherwise to charge the system.

The secondary container may be permanently attached to the body and even can be unitarily formed therewith. However, in a preferred embodiment of the dispensing pump of the invention, the secondary container is replaceably detachable from the secondary attachment means. This provides for convenient refilling after the contents of an initial secondary container have been exhausted.

When combined with the separation of the primary and secondary containers and the attachment of the secondary container in such a manner that its contents can pass immediately into the mixing chamber, the possibility becomes apparent of using various replacement secondary containers having contents that differ from each other. Each secondary container can be made of materials selected to be specifically appropriate for the long-term containment of its contents. Furthermore, because a minimal amount of secondary container contents is required to prime the system and reach the mixing chamber, only a minimal amount of waste spray must be disposed of before the new contents have charged the system. When the secondary container is replaceably detachable, it is preferred that the secondary check valve be a part of the secondary container.

In another preferred embodiment, the dispensing pump includes metering means for metering fluid from the primary container and material contained in the secondary container into the mixing chamber in a selected ratio. This is especially valuable when the material of the secondary container, for example, is a concentrate or a highly active material that is intended to be mixed with fluid from the primary container in a specific relative amount to achieve an end spray of a desired concentration or a particular activation effect. Various alternative embodiments of the metering means are described below in the detailed description of the invention.

The primary fluid and the contents of the secondary container may be mutually incompatible. Materials shall be understood to be "incompatible" if they are either destroyed, modified, reduced in activity, made less stable, or otherwise altered by extended exposure to the other materials to be co-delivered by the pump or would have such an effect on those other materials. "Extended" exposure shall mean exposure for at least the minimal time the materials are expected to be stored in the pump and the primary and secondary containers prior to use. The contents of the secondary container preferably include an active ingredient selected from the group consisting of scents, cleaning active ingredients, biocides, and pest control active ingredients. "Cleaning active ingredients" includes but is not limited to bleaches, surfactants, acids, enzymes, and the like. "Biocides" includes but is not limited to anti-bacterials, anti-molds, herbicides, and the like. "Pest control active ingredients" includes ingredients to kill or alter the behavior or development of pests such as insects, arachnids, chilopods, diplopods, and the like.

Yet another aspect, the invention includes a secondary container for containing selected contents for use with the dispensing pump disclosed above. The secondary container includes a contents-tight holding chamber having an outlet and mating means by which the secondary container may be attached to the secondary attachment means of the dispensing pump, with the outlet in immediate communication with the sprayer mechanism of the pump. The secondary container so described is intended for use as a refill for the dispensing pump to renew the supply of the secondary container's contents. Alternatively, different contents or different content delivery rates could be provided in different secondary containers. By this means, it is possible to select between alternative secondary container contents or to select among differing ratios of secondary container contents to the primary fluid in the spray delivered by the pump.

DETAILED DESCRIPTION

Figure 1:
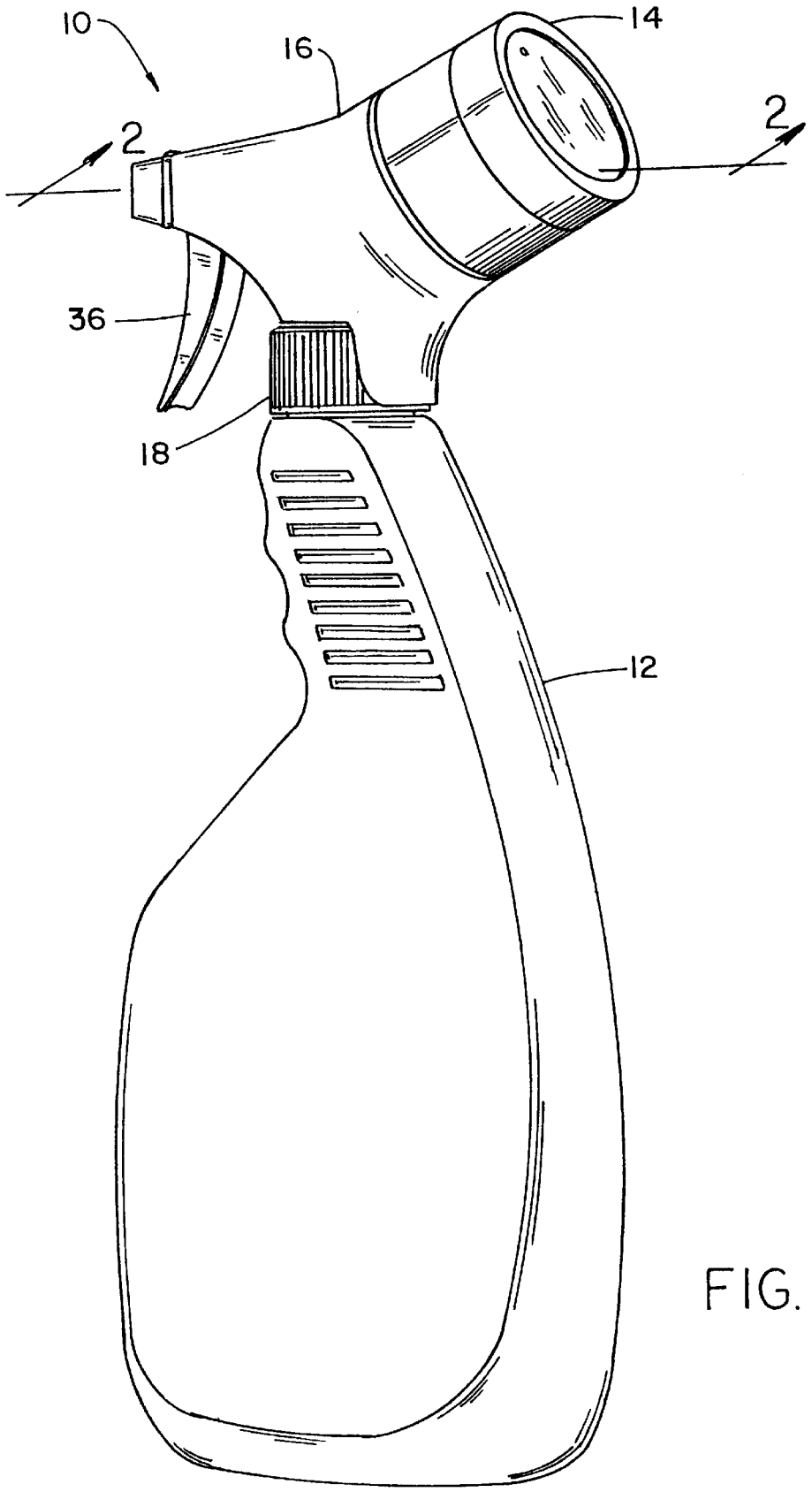
FIG. 1 is a perspective view from the back and to one side of a preferred embodiment of the dispensing pump of the invention, attached to a conventional bottle serving as a primary container.
Figure 2:
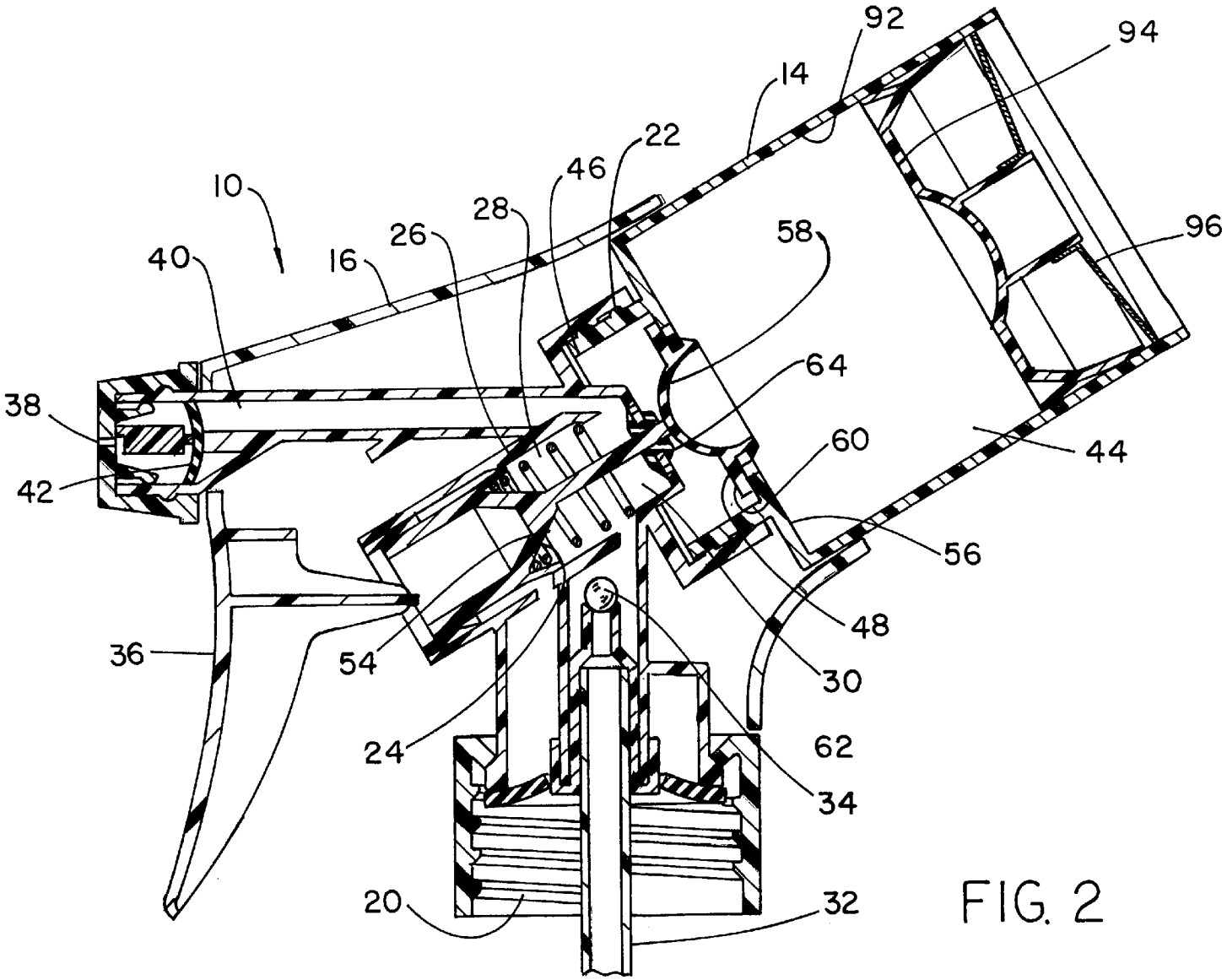
FIG. 2 is a partially schematic and simplified cross sectional view of the dispensing pump of FIG. 1, without the bottle, the cross sectional view taken along section lines 2—2 of FIG. 1.

Referring now to the drawings, wherein like parts of the same embodiment and strictly corresponding parts of alternative embodiments are indicated by like reference numbers, a preferred embodiment of the manually operable dispensing pump of the invention is shown generally in FIG. 1 and, in cross section, in FIG. 2 at 10, the pump 10 being shown in FIG. 1 mounted on a primary container 12. The primary container 12 shown in FIG. 1 is a conventional bottle of a general sort common in the art of trigger spray products. The primary container 12 is intended to contain a primary fluid (not shown).

The dispensing pump 10 is used with and may include a secondary container 14 having contents (not shown) to be co-dispensed with the primary fluid. The dispensing pump 10 has a body 16 that has primary attachment means to attach the body 16 to the primary container 12, such as the threads 20 shown in FIG. 2. The pump 10 also has secondary attachment means to which the secondary container 14 can be attached, such as the secondary threads 22 shown in FIG. 2. Alternative embodiments of the primary and secondary attachment means, such as but not limited to bayonet, snapped, and press fit attachments, will be apparent to one skilled in the art and are included within the breadth and scope of the invention.

The dispensing pump 10 includes a sprayer mechanism held by or formed within the body 16. The sprayer mechanism includes a piston 24 and cylinder 26 having cylinder head space 28 above the face of the piston. A mixing chamber 30 is provided that is in fluid communication with the cylinder head space 28. The sprayer mechanism also includes a dip tube 32, a collapsible or non-vented bottle, or other primary fluid transfer means for transferring fluid to the mixing chamber 30 from the primary container 12. The primary fluid transfer means includes a primary check valve 34, such as the conventional ball valve shown schematically in FIGS. 2, 5–7. The primary check valve 34 allows fluid being transferred via the primary fluid transfer means to flow only toward and not away from the mixing chamber 30.

The sprayer mechanism also includes a finger operated trigger 36 or other manual operating means for reciprocatingly moving the piston 24 within the cylinder 26, alternatingly increasing and decreasing the cylinder head space 28 to draw primary liquid and contents of the secondary container into and then expel them from the mixing chamber 30. Preferably, the cylinder head space 28 can itself serve as the mixing chamber 30, as is illustrated in the embodiment of FIGS. 2, 4–7. However, a separate chamber simply in fluid communication with the cylinder head space 28 can also serve as the mixing chamber 30, either by itself or in combination with the cylinder head space. Such an arrangement is shown in the embodiment of the pump 10 shown in FIG. 3.

The sprayer mechanism also includes a discharge orifice 38, together with a discharge conduit 40 that provides fluid communication between the mixing chamber 30 and the discharge orifice. The discharge conduit 40 has a discharge check valve 42 that permits fluid to move in the discharge conduit only toward the discharge orifice 38 and not back toward the mixing chamber 30.

The secondary container 14 is attachable directly to the body 16 of the pump 10 by the secondary attachment means at a location remote from the primary attachment means. The secondary container 14 includes a holding chamber 44 for holding selected contents and an outlet 46 that provides immediate communication between the holding chamber and the sprayer mechanism when the secondary container is attached to the body 16.

The attachment of the secondary container 14 to the body 16 is achieved in such a manner that contents of the secondary container can pass immediately into the mixing chamber 30. A secondary check valve 48 permits contents of the holding chamber 44 to move only toward and not away from the mixing chamber 30. The secondary check valve 48 may be either part of the sprayer mechanism (as in the embodiment of the pump 10 shown in FIG. 7) or part of the secondary container 14 (as in the embodiments shown in FIGS. 2–6).

As a consequence of the structure disclosed above, when a user moves the piston 24 by use of the manual operating means, contents of the secondary container 14 and fluid from the primary container 12 both first are drawn into the mixing chamber 30, where they intermingle. They then are expelled through the discharge orifice 38 via the discharge conduit 40.

Figure 3:
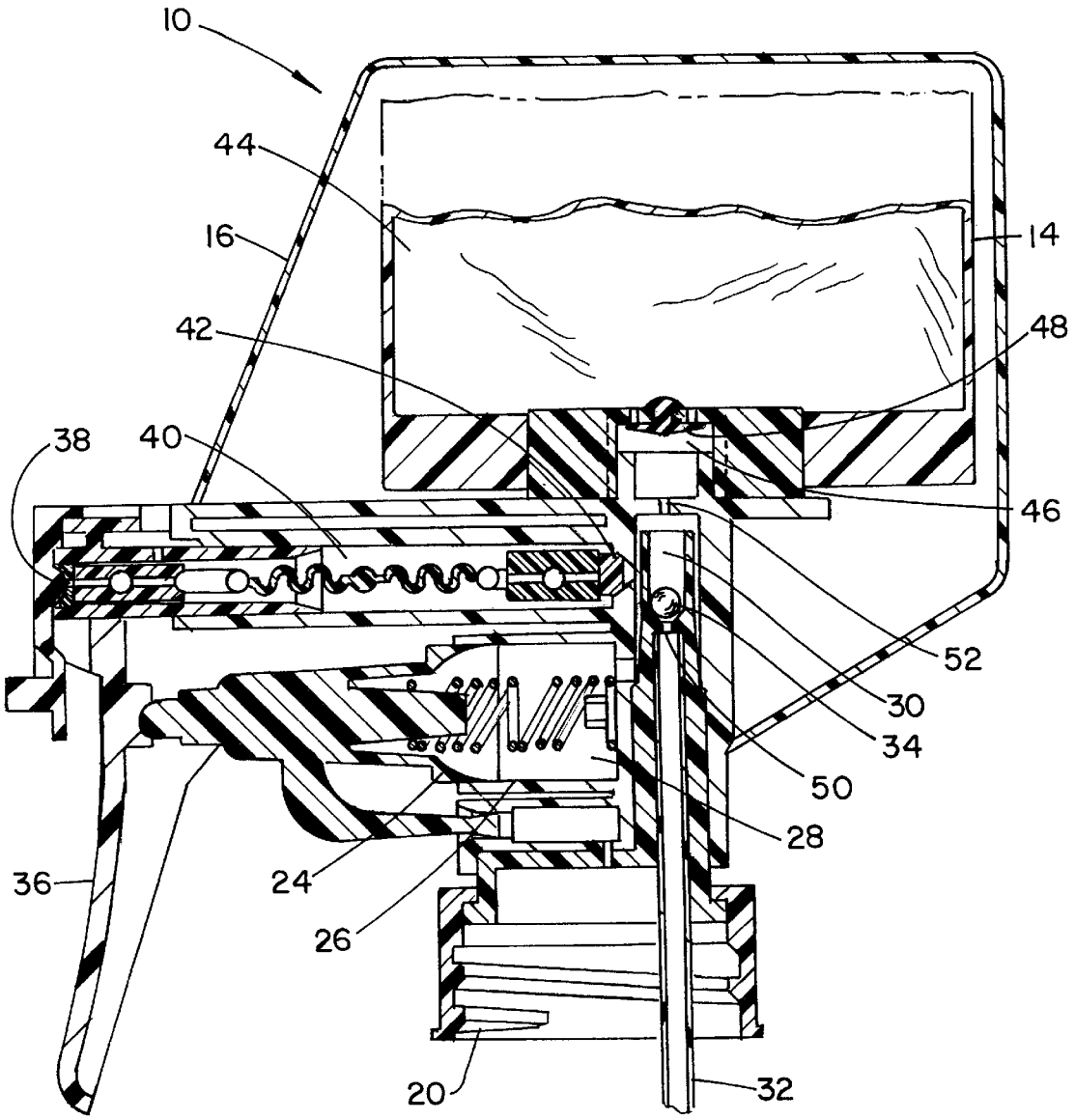
FIG. 3 is a partially schematic and simplified cross sectional view of an alternative embodiment of the dispensing pump of the invention, corresponding to the view of FIG. 2.
Figure 4:
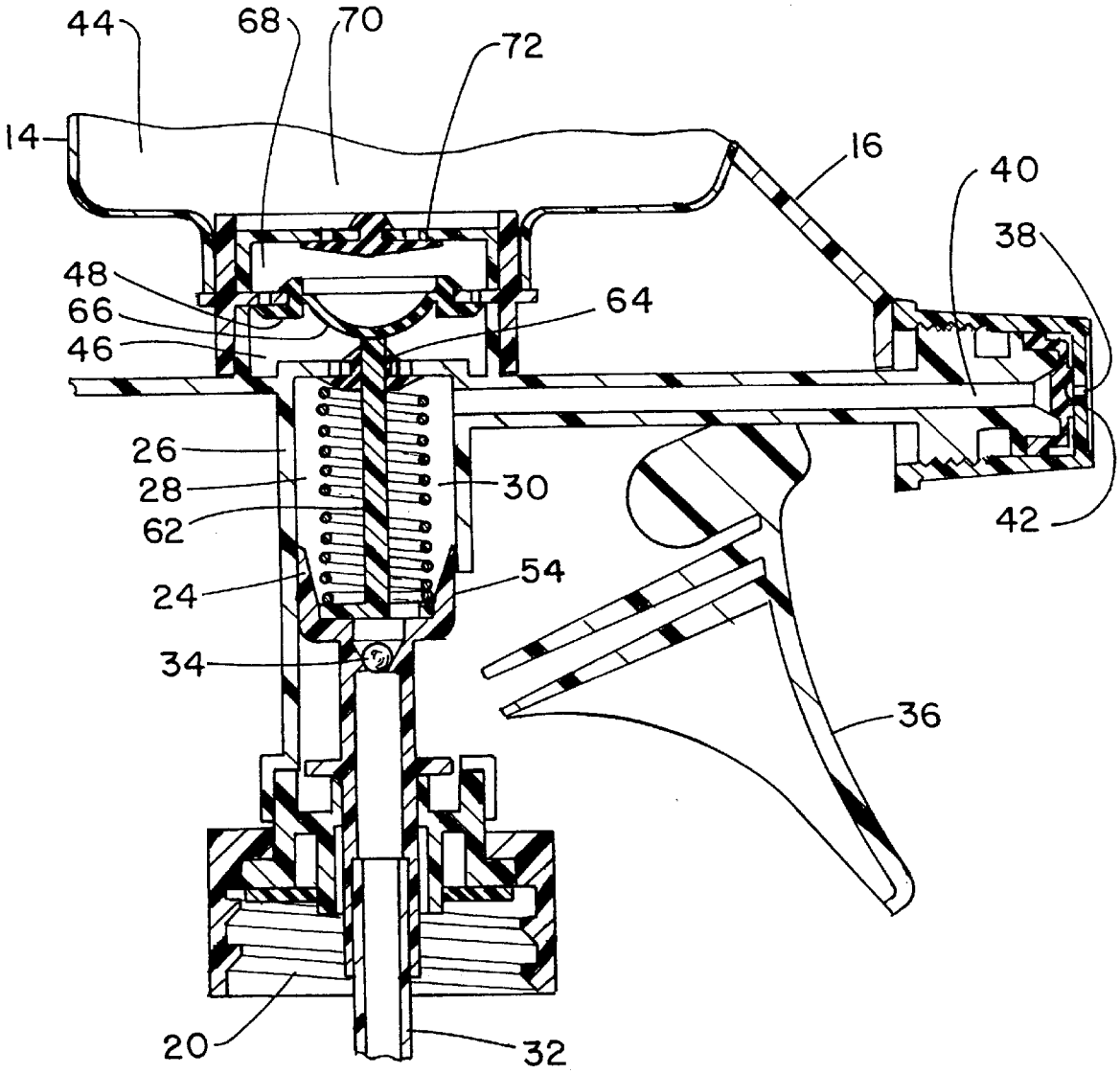
FIG. 4 is a partially schematic and simplified cross sectional view of an alternative embodiment of the dispensing pump of the invention, corresponding to the view of FIG. 2, with the upper portion of the secondary container truncated.

The secondary container 14 may be permanently attached to the body 16, as in the embodiments shown in FIGS. 3 and 4, and even can be unitarily formed therewith. However, in a preferred embodiment of the dispensing pump 10, the secondary container 14 is replaceably detachable from the secondary attachment means, as in the embodiments shown in FIGS. 2, 5, 6, and 7. Such replaceable attachment allows convenient substitution of a full secondary container 14 after the contents of an initial secondary container have been exhausted. Other advantages of replaceable attachment have been discussed, above. When the secondary container 14 is replaceably detachable, it is preferred that the secondary check valve 48 be a part of the secondary container.

It is preferred that the dispensing pump 10 include metering means for metering fluid from the primary container 12 and material contained in the secondary container 14 into the mixing chamber 30 in a selected ratio. Alternative embodiments of the metering means arc shown in FIGS. 2–7 and are discussed, below. The advantages of the metering means are discussed, above.

Figure 7:
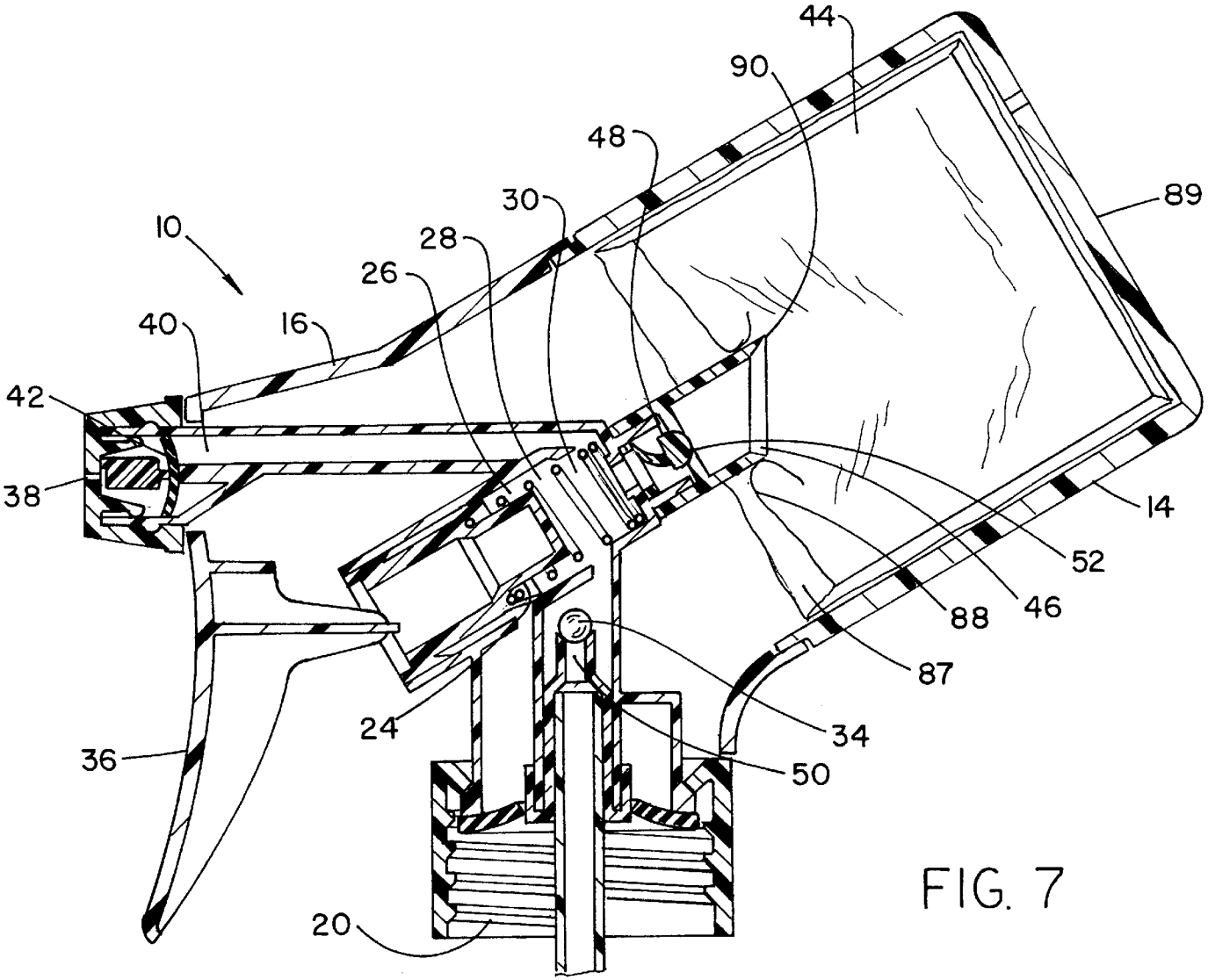
FIG. 7 is a partially schematic and simplified cross sectional view of an alternative embodiment of the dispensing pump of the invention, corresponding to the view of FIG. 2.

In the embodiments shown in FIGS. 3 and 7, the metering means includes a primary orifice 50 of a selected size through which fluid from the primary container 12 must flow as it moves toward the mixing chamber 30. A secondary orifice 52 of a selected size is also provided through which material contained in the secondary container 14 must pass as it moves toward the mixing chamber 30. The ratio of the primary container fluid to the secondary container material entering the mixing chamber 30 is determined by the relative sizes of the primary and secondary orifices 50,52. Preferably, when the secondary container 14 is replaceably detachable from the secondary attachment means, the secondary orifice 52 is a part of the secondary container.

Figure 5:
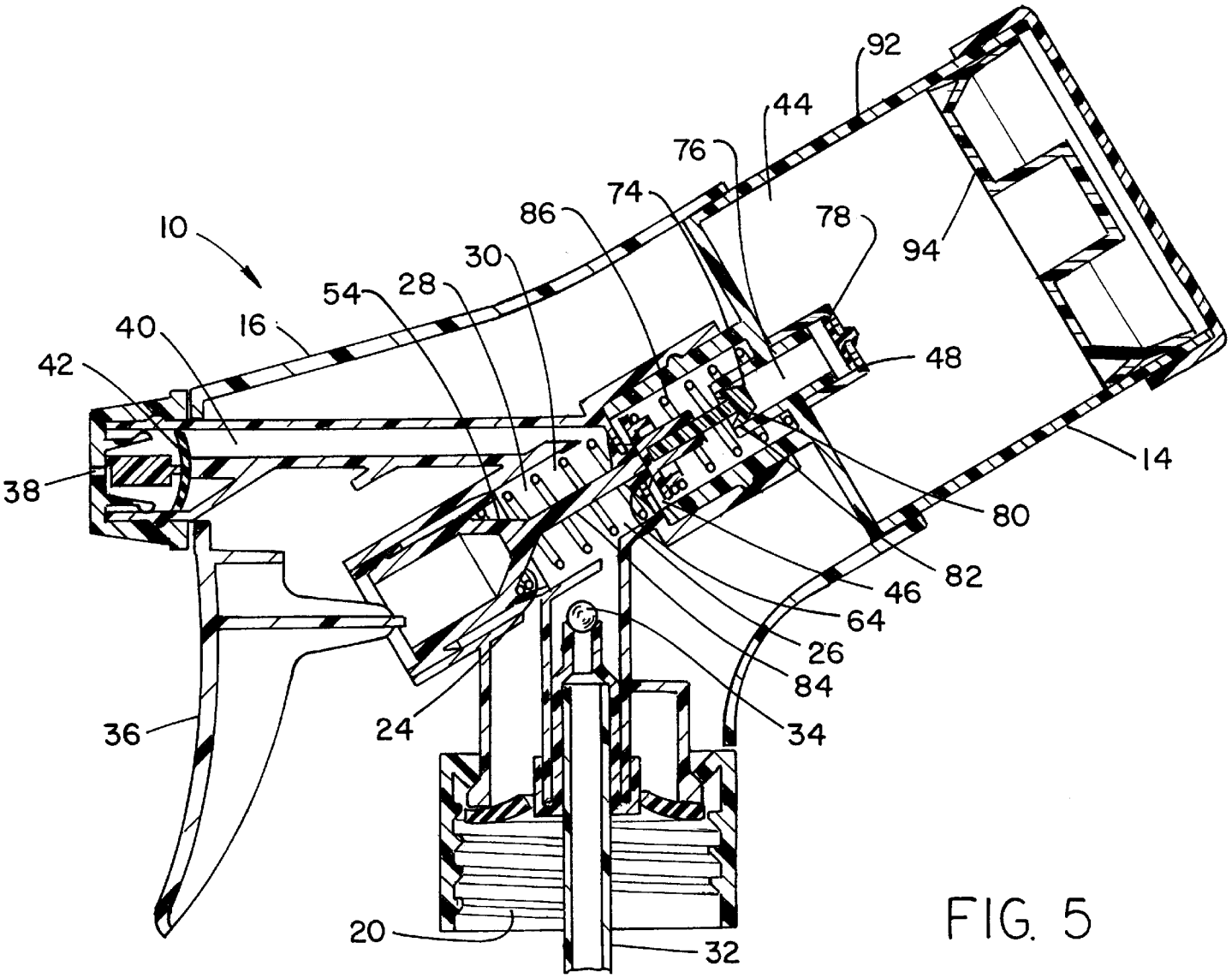
FIG. 5 is a partially schematic and simplified cross sectional view of an alternative embodiment of the dispensing pump of the invention, corresponding to the view of FIG. 2.
Figure 6:
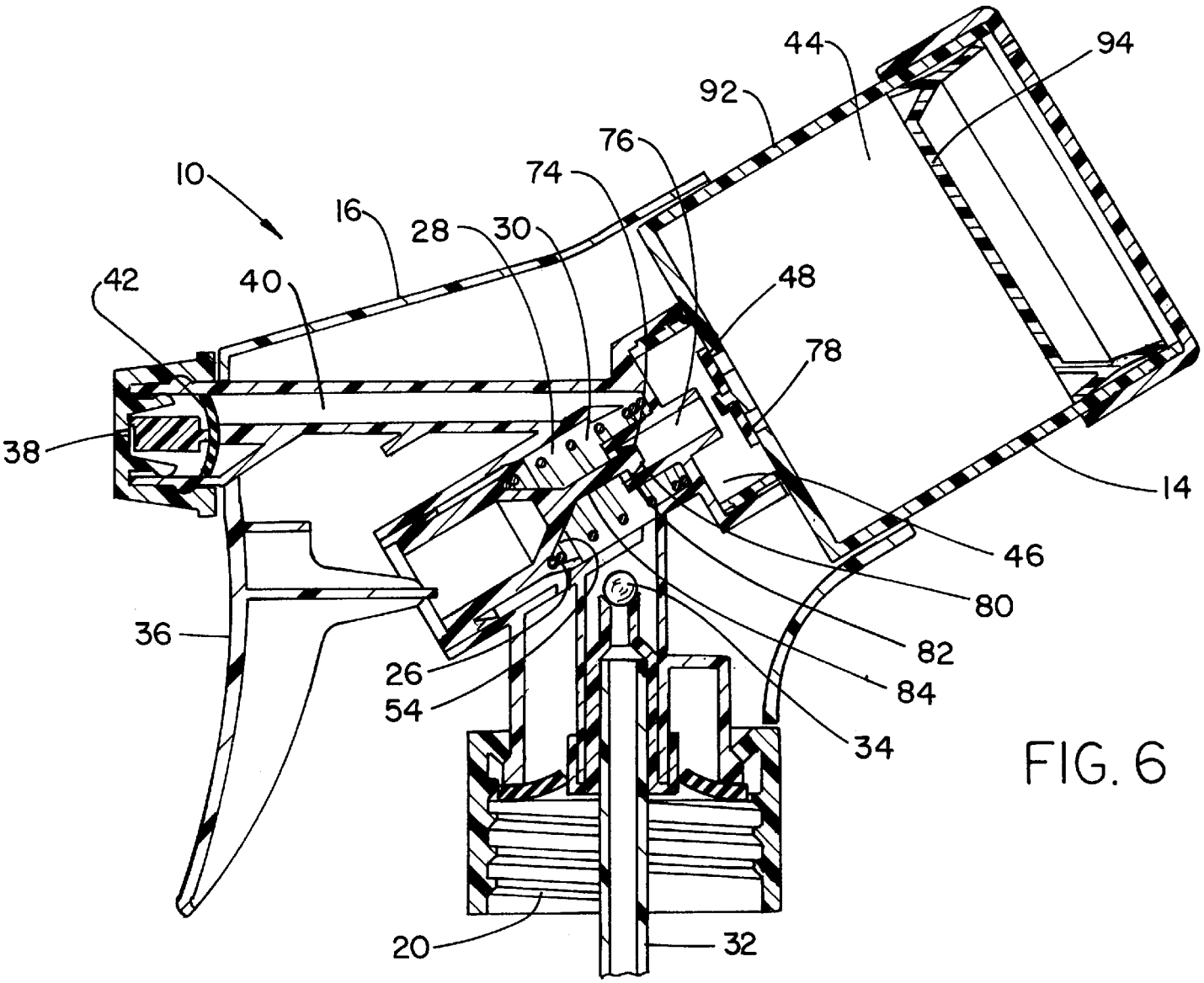
FIG. 6 is a partially schematic and simplified cross sectional view of an alternative embodiment of the dispensing pump of the invention, corresponding to the view of FIG. 2.

Alternative metering means may be provided that have other advantages. For example, the piston 24 of the dispensing pump 10 described above may be designated to be the "primary piston 54," having a selected primary piston displacement. The metering means may then include secondary pumping means for moving contents from the holding chamber 44 toward the mixing chamber 30. The secondary pumping means may be located either in the body 16 (as shown in the embodiment of FIG. 6) or in the secondary container 14 (as shown in the embodiments of FIGS. 2, 4–5).

The secondary pumping means operates in physical coordination with the primary piston 54, being driven mechanically, hydraulically, or by other means, the secondary pumping means having a selected secondary displacement. The primary piston 54 pumps fluid from the primary container 12 and the secondary pumping means pumps contents from the secondary container 14, with the relative amounts of the primary container fluid and secondary container contents delivered to the mixing chamber 30 being determined respectively by the displacements of the primary piston 54 and secondary pumping means. When the secondary container 14 is replaceably detachable from the secondary attachment means, it is preferred but not required that the secondary pumping means form a part of the secondary container.

Various secondary pumping means are possible and representative and preferred embodiments are illustrated in FIGS. 2–6. In the embodiment of FIG. 2, the secondary container's holding chamber 44 has a wall 56, and the secondary pumping means includes a flexible membrane 58 located in the holding chamber wall. Means are provided for flexing the membrane 58 into and out of the holding chamber 44 in physical coordination with the movement of the primary piston 54. A one-way valve 60 allows holding chamber contents to be pumped out through the holding chamber outlet 46 toward the mixing chamber 30 when the membrane 58 is flexed inwardly with respect to the holding chamber 44, increasing the internal pressure of the contents of the holding chamber, the holding chamber being such that flow outwardly through the valve 60 is the means of least resistance to relieve pressure within the holding chamber. The one-way valve 60 prevents the contents from returning therethrough when the membrane 58 is flexed outwardly. Preferably, the one-way valve 60 is mounted directly in the holding chamber wall 56, as is shown in FIG. 2, and either constitutes or is in direct fluid communication with the holding chamber outlet 46.

In the embodiment of FIG. 2, the means for flexing the membrane 58 includes a piston extension rod 62 driven by the primary piston 54. The piston extension rod 62 pushes against the membrane 58 when the primary piston 54 is moved, flexing the membrane. Although it is not required, it is preferred that, as shown in FIG. 2, the piston extension rod 62 be co-axial with the primary piston 54, extending from the face of the primary piston out through the end of its cylinder. The piston extension rod 62 may only contact and not be attached to the primary piston 54. The piston extension rod 62 may even form a part of the secondary pumping means. However, it is preferred that the piston extension rod 62 be physically attached to or at least engaged by the primary piston 54. Preferably the piston extension rod 62 is slideably embraced by a seal, such as that shown at 64 in FIG. 2, that prevents the free intermixing of the contents of the head space above the face of the primary piston 54 and any material in contact with the surface of the seal distal to the primary piston. The slidable seal 64 also prevents the leaking of primary fluid when the secondary container 14 is removed for replacement.

Other possible arrangements of the piston extension rod will be apparent to those skilled in the art such as a side location, with the piston extension rod being attached directly or indirectly to the primary piston at a point remote from its face but nevertheless moving with and being driven by the primary piston. Such alternative arrangements are within the breadth and scope of the invention. In any event, when the secondary container 14 is removably attachable to the secondary attachment means, it is preferred that the flexible membrane 58 form a part of the secondary container and that the means for flexing the membrane remain a part of the sprayer mechanism of the body 16 when the secondary container is removed, whether a piston extension rod or other flexing means is employed.

The flexible membrane 58 preferably is made of a resilient material that springs back to its original shape after it has been flexed, thus being prepared for a second pumping stroke. Alternatively, a spring (not shown) or other affirmative mechanical means of restoring the flexing membrane to its original position may be provided. However, when the primary piston 54 is so moved that the mixing chamber 30 is under a negative pressure with respect to the secondary container holding chamber 44, the flexible membrane 58 will be urged toward its original position simply by the pressure differential.

An alternative pumping means related to the flexible membrane arrangement just described is shown in the embodiment of FIG. 4. In the embodiment of FIG. 4, the holding chamber 44 includes a compression chamber 68 and a reservoir 70, the two being in communication via a one-way compression chamber valve 72 that permits flow of reservoir contents only into and not out of the compression chamber. The secondary check valve 48 preferably is located in the wall of the compression chamber 68. A flexible membrane shown at 66, generally similar in physical characteristics and pumping function to the membrane 58 of the embodiment of FIG. 2, may be flexed inwardly into the compression chamber 68, forcing contents of the compression chamber out through the secondary check valve 48. When the flexible membrane 66 returns to its original position, reservoir contents are drawn into the compression chamber 68 via the one-way compression chamber valve 72. This arrangement permits the reservoir 70 to be a limp bag or other collapsible structure, the advantages of such reservoirs being discussed below.

In an alternative and more preferred embodiment, the secondary pumping means includes a secondary piston with a secondary cylinder such as those shown respectively at 74 and 76 in the embodiments of FIGS. 5 and 6. The secondary cylinder 76 is in communication with both the holding chamber 44 of the secondary container 14 and the mixing chamber 30. At least one one-way valve 78 permits flow of holding chamber contents only toward the mixing chamber 30. Means are provided to drive the secondary piston 74 in physical coordination with the primary piston 54 to pump contents from the holding chamber 44 and then pump the contents toward the mixing chamber 30.

The secondary piston 74 may have a peripheral seal 80 that is biased against the sides of its cylinder 76 and is so made that, if there is no alternative flow path of less resistance, material contained in the head space above the secondary piston will blow by the peripheral seal as the head space is compressed when the secondary piston is moved toward the end of the secondary cylinder 76. If the space behind the secondary piston 74 is in communication with the mixing chamber 30, the peripheral seal 80 can itself function as a one-way valve permitting flow of holding chamber contents only toward the mixing chamber. If the peripheral seal 80 is a resilient and flexible skirt-like flange extending rearwardly from the head of the secondary piston 74 to contact the walls of the secondary cylinder 76 (as is the peripheral seal shown in the Figures), the flange will distort readily to allow material under pressure to pass by it from the face of the secondary piston toward its rear. However, the flange's own resiliency and/or fluid pressure from the opposite direction will cause the flange to press more tightly against the walls of the secondary cylinder 76, resulting in increased resistance to back flow.

The primary and secondary pistons 54,74 may be located side by side with their physically coordinated movement being achieved by their being actuated by a single trigger with appropriate linkage well known in the art, and other arrangements of the pistons and other means to physically coordinate their movement will be apparent to one skilled in the art. However, it is preferred that the means to drive the secondary piston 74 include a piston extension rod 84 comparable to the piston extension rod 62, driven by the primary piston 54 and adapted to move the secondary piston within the secondary cylinder 76. The piston extension rod 84 may either be fastened to the secondary piston 74 (by unitary construction, a ball and socket arrangement, or other means) or may simply contact it. In the latter case, it is preferred that the means to drive the secondary piston include a secondary spring 86 that biases the secondary piston backwardly, the piston extension rod and the secondary spring cooperatively moving the secondary piston in physical coordination with the primary piston 54.

Although the presence of the secondary spring 86 is preferred to help move the secondary piston 74 backwardly after it has been thrust toward the end of the secondary cylinder 76, other arrangements are possible. For example, if the space behind the head of the secondary piston 74 is in communication with the mixing chamber 30, when the mixing chamber is under reduced pressure as the primary piston 54 withdraws, the space behind the head of the secondary piston will similarly be under reduced pressure. If that pressure is less than the pressure of the contents in the secondary container holding chamber 44, the pressure differential can be sufficient to move the secondary piston backwardly, without need for a biasing spring.

When the secondary container 14 is removably attached to the secondary attachment means, it is preferred that the secondary piston 74 and its cylinder 76 form a part of the secondary container, together with the secondary spring 86, if such a spring is used, while the means to drive the secondary piston remains a part of the sprayer mechanism of the body 16 when the secondary container is removed. Such an arrangement is shown in the embodiment of FIG. 5.

The contents of the secondary container 14 may be a fluid, including either liquids or gasses, and may also include pumpable solid particles. "Solid" in this context shall be deemed to refer to any material capable of existing as a discreet particle of non-flowable material, including traditional solids, gel particles, and the like. A solid particle shall be deemed "pumpable" if it has characteristics such that it can be drawn through the valves and other routes within the dispensing pump 10 through which fluid is forced by action of the pump to be discharged therefrom. A stable suspensions of such particles within liquids are preferred.

The primary fluid and the contents of the secondary container 14 may be mutually incompatible. Materials shall be understood to be "incompatible" if they are either destroyed, modified, reduced in activity, made less stable, or otherwise altered by extended exposure to the other materials to be co-delivered by the pump or would have such an effect on those other materials. "Extended" exposure shall mean exposure for at least the minimal time the materials are to be stored in the pump 10 and the primary and secondary containers 12,14 prior to use.

Figure 8:
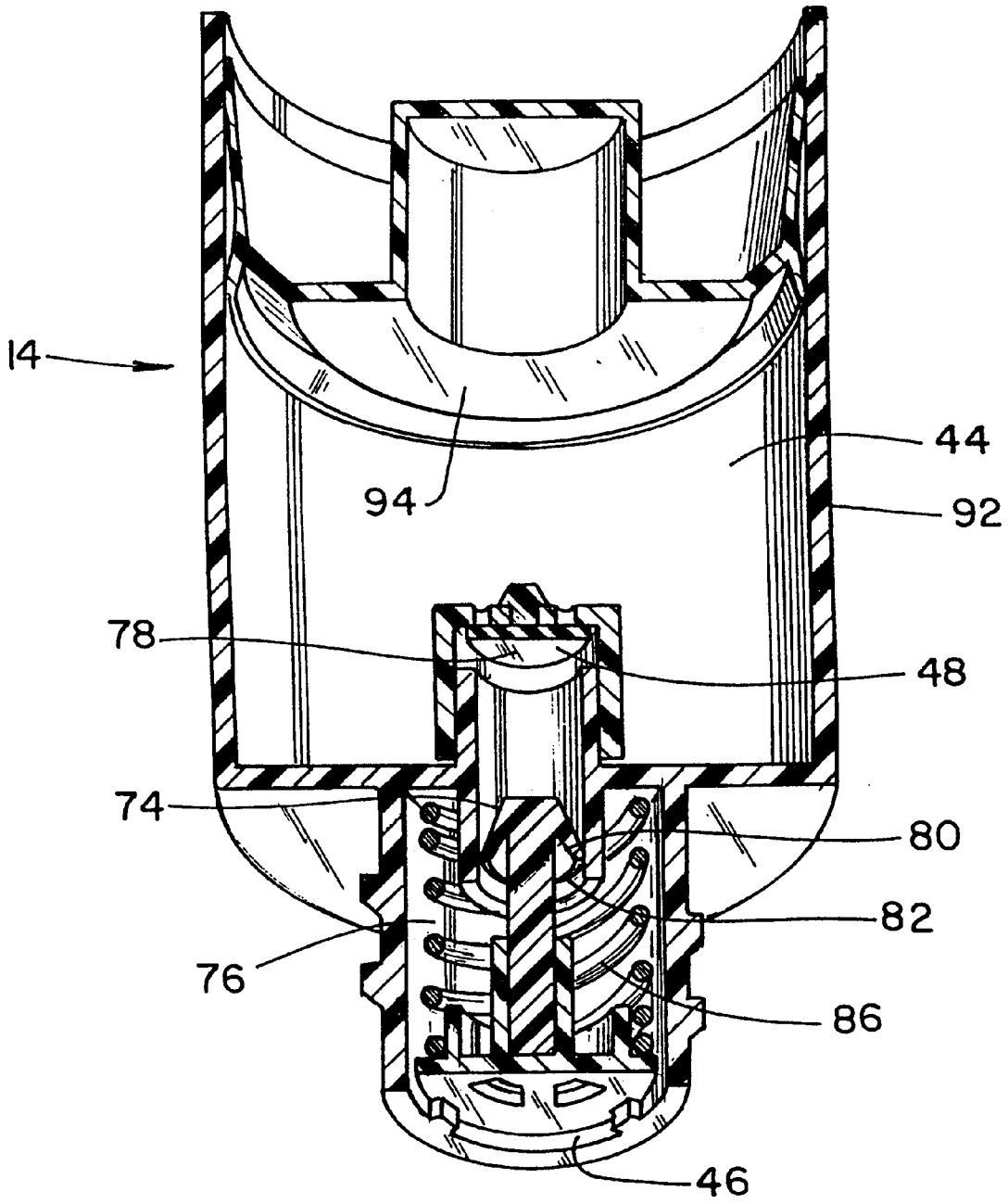
FIG. 8 is a cross sectional view of a secondary container of the invention taken axially, along the midline of the secondary container, with the secondary container shown in perspective from in front and below.

The invention may also be understood as an independently existing, separable secondary container 14 for containing selected contents for use with the dispensing pump disclosed above and having the features described above for the secondary container when it has been disclosed in embodiments that may be removed from the secondary attachment means. FIG. 8 shows a preferred embodiment of such an independently existing secondary container 14. The secondary container 14 includes a contents-tight holding chamber 44 having an outlet 46 and mating means by which the secondary container may be attached to the secondary attachment means of the dispensing pump, with the outlet in immediate communication with the sprayer mechanism of the pump 10. The secondary container 14 so described is intended for use as a refill for the dispensing pump 10 to renew the supply of the secondary container's contents or to allow for selectable, different contents or different contents delivery rates provided in different secondary containers.

Because the removable secondary container 14 is intended to be handled and marketed as an independent object, not already attached to a dispensing pump, it is preferred that a removable closure means be provided to prevent loss of the contents of the secondary container prior to its installation on the pump 10. Such closure means may be a cap (not shown) that removably attaches to the mating means. Alternatively, a pierceable seal be provided to close the outlet 46 in contents-tight relation to avoid leakage and preserve the contents from contact with the surrounding environment. The art is well acquainted with seals made of such materials as foil, paper, and plastic that are suitable for this application. When such a seal is used, it is preferred that the secondary attachment means of the dispensing pump include seal-piercing means to pierce the seal and provide immediate communication between the outlet of the secondary container and the sprayer mechanism of the dispensing pump. In the secondary container 14 shown in FIG. 7 installed on a pump 10, the holding chamber 44 includes a collapsible pouch 87 contained within a rigid shell 89. The collapsible pouch 87 has a pierceable wall 88 that faces toward the pump when the secondary container 14 is installed on the pump 10, the pierceable wall itself functioning as the seal. The embodiment of the pump 10 shown in FIG. 7 includes a sharp prong 90 adapted to pierce the wall 88 as the secondary container is moved into position on the pump. The wall 88 preferably is made of materials known to the art that tend to surround and seal to a piercing object, such as the prong 90, to adhere to the prong in contents-tight relation.

As contents of the holding chamber 44 are removed therefrom by the dispensing pump 10, the holding chamber would acquire a negative pressure, absent venting or other means to relieve that pressure. The holding chamber 44 of the embodiment of the secondary container 14 shown in FIG. 3 is a collapsible bag that can simply decrease in volume to relieve that pressure. In the embodiment of FIG. 8, the holding chamber has rigid side walls 92 and an end wall 94 spaced from the outlet 46. The margin of the end wall 94 has a slideable seal adapted to slide within the side walls in contents-tight relation. By this means, as the contents of the holding chamber 44 are pumped therefrom, the end wall 94 may slide toward the outlet 46, allowing the volume of the holding chamber to decrease, thereby eliminating the need to vent the holding chamber. A retention spring, such as that shown at 96 in the embodiment of FIG. 2, may be used to prevent backwards movement of the end wall 94.

Other means to reduce the size of the holding chamber 44 as its contents are removed will be apparent to those skilled in the art, including but not limited to holding chambers 44 that are partly rigid but include flexible wall portions that can move inwardly as the contents of the chamber are removed. Alternatively, the holding chamber 44 can be vented by any of the various means well known to the art.

It is also preferred that the secondary container 14 include a secondary pumping means for pumping contents from the secondary container through the outlet 46. The secondary pumping means is adapted to operate in physical coordination with the primary piston 54 when the secondary container is attached to the body 16 of the dispensing pump 10. Alternative embodiments and the function of the secondary pumping means with respect to metering relative quantities of the contents of the secondary holding chamber 14 and fluid contained within the primary holding chamber 12 are set forth in detail above.

All parts of the pump 10 may be manufactured from suitable plastics and elastomerics well known to those skilled in the art by standard molding techniques. Springs may be made conventionally of suitable metals or plastics.

Embodiments of the invention alternative to those disclosed above will be apparent to those skilled in the art, even though such alternatives are within the breadth and scope of the invention. The invention is defined not by the preferred embodiments disclosed but by the claims set forth below.

Industrial Applicability

The usefulness of pumps for co-dispensing materials is well established in the art, as are the means for manufacture referred to above.

We claim:

1. A manually operable dispensing pump for use with a primary container containing a primary fluid, the dispensing pump comprising:

a. a body having
   i. primary attachment means to attach the body to the primary container; and
   ii. secondary attachment means;

b. the body including a sprayer mechanism that includes
   i. a piston and cylinder having a cylinder head space above the piston;
   ii. a mixing chamber in fluid communication with the cylinder head space;
   iii. primary fluid transfer means for transferring fluid to the mixing chamber from the primary container, including a primary check valve that allows fluid being transferred to flow only toward and not away from the mixing chamber;
   iv. manual operating means for reciprocatingly moving the piston within the cylinder, alternatingly increasing and decreasing the cylinder head space to draw contents into the mixing chamber and then to expel the contents; and
   v. a discharge orifice and a discharge conduit that provides fluid communication between the mixing chamber and the discharge orifice, the discharge conduit having a discharge check valve that permits fluid to move in the discharge conduit only toward the discharge orifice; and c. a secondary container attachable by the secondary attachment means directly to the body at a location remote from the primary container, the secondary container having a holding chamber for holding selected contents and an outlet that provides immediate communication between the holding chamber and the sprayer mechanism when the secondary container is attached to the body so that contents of the secondary container can pass immediately into the mixing chamber, one of the sprayer mechanism and the secondary container having a secondary check valve that permits contents of the secondary container to move only toward and not away from the mixing chamber;

whereby, when a user moves the piston by use of the manual operating means, contents of the secondary container and fluid from the primary container both first are drawn into the mixing chamber and then are expelled through the discharge orifice via the discharge conduit.

2. The dispensing pump of claim 1 wherein the secondary container is replaceably detachable from the secondary attachment means.

3. The dispensing pump of claim 2 wherein the secondary check valve is a part of the secondary container.

4. The dispensing pump of claim 1 including metering means for the metering of fluid from the primary container and material contained in the secondary container into the mixing chamber in a selected ratio.

5. The dispensing pump of claim 4 wherein the metering means includes a primary orifice of a selected size through which fluid from the primary container must flow as it moves toward the mixing chamber and a secondary orifice of a selected size through which material contained in the secondary container must pass as it moves toward the mixing chamber, the ratio of the primary container fluid to the secondary container material entering the mixing chamber being determined by the relative sizes of the primary and secondary orifices.

6. The dispensing pump of claim 4 wherein a. the piston constitutes a primary piston having a selected primary piston displacement, and b. the metering means includes a secondary pumping means for moving contents from the secondary container toward the mixing chamber, the secondary pumping means being located in one of the body and the secondary container, operating in physical coordination with the primary piston, and having a selected secondary displacement, the primary piston pumping fluid from the primary container and the secondary pumping means pumping contents from the secondary container, with the relative amounts of the primary container fluid and secondary container contents delivered by the primary piston and the secondary pumping means being determined respectively by the displacements of the primary piston and secondary pumping means, thereby determining the ratio of those amounts that enter the mixing chamber.

7. The dispensing pump of claim 6 wherein the secondary container is replaceably detachable from the secondary attachment means and the secondary pumping means forms a part of the secondary container.

8. The dispensing pump of claim 6 wherein the holding chamber of the secondary container has a wall and the secondary pumping means includes a. a flexible membrane located in the holding chamber wall;

b. means for flexing the membrane into and out of the holding chamber in physical coordination with the movement of the primary piston; and c. a one-way valve allowing holding chamber contents to be pumped out through the holding chamber outlet toward the mixing chamber when the membrane is flexed inwardly but preventing the contents from returning therethrough when the membrane is flexed outwardly.

9. The dispensing pump of claim 8 wherein the means for flexing the membrane includes a piston extension rod driven by the primary piston that pushes against the membrane when the primary piston is moved.

10. The dispensing pump of claim 8 wherein the secondary container is removably attached to the secondary attachment means and the flexible membrane forming a part of the secondary container and the means for flexing the membrane remaining a part of the sprayer mechanism of the body when the secondary container is removed.

11. The dispensing pump of claim 6 wherein a. the holding chamber includes a compression chamber and a reservoir, with a one-way valve communicating therebetween that permits flow of reservoir contents only into and not out of the compression chamber, the secondary check valve being located in a wall of the compression chamber; and, b. located in a wall of the compression chamber, a flexible membrane that may be flexed inwardly into the compression chamber by means for flexing the membrane, to force contents of the compression chamber out through the secondary check valve, reservoir contents being drawn into the compression chamber via the one-way valve when the flexible membrane returns to its original position.

12. The dispensing pump of claim 6 wherein the secondary pumping means includes a. a secondary piston and a secondary cylinder that is in communication with the holding chamber of the secondary container and the mixing chamber, with one-way valves permitting flow of holding chamber contents only toward the mixing chamber; and b. means to drive the secondary piston in physical coordination with the primary piston to pump contents from the holding chamber and then pump the contents toward the mixing chamber.

13. The dispensing pump of claim 12 wherein the means to drive the secondary piston includes a piston extension rod driven by the primary piston, the piston extension rod moving the secondary piston in physical coordination with the primary piston.

14. The dispensing pump of claim 12 wherein a. the secondary container is removably attached to the secondary attachment means;

b. the secondary piston is a part of the secondary container; and c. the means to drive the secondary piston remains a part of the sprayer mechanism of the body when the secondary container is removed.

15. The dispensing pump of claim 14 wherein the means to drive the secondary piston includes a piston extension rod driven by the primary piston and adapted to move the secondary piston from a first position within the secondary cylinder toward a second position and a secondary spring that biases the secondary piston back toward the first position, the piston extension rod and secondary spring moving the secondary piston in physical coordination with the primary piston.

16. The dispensing pump of claim 1 wherein the contents of the secondary container is a fluid.

17. The dispensing pump of claim 1 wherein the contents of the secondary container includes pumpable solid particles.

18. The dispensing pump of claim 1 wherein the primary fluid and the contents of the secondary container are mutually incompatible.

19. A secondary container suitable for use in the dispensing pump of claim 1, the secondary container comprising a contents-tight holding chamber having an outlet and mating means by which the secondary container may be attached to the secondary attachment means with the outlet in immediate communication with the sprayer mechanism of the dispensing pump.

20. The secondary container of claim 19 including a pierceable seal closing the outlet in contents-tight relation, where the secondary attachment means of the dispensing pump includes seal-piercing means to pierce the seal to provide immediate communication between the outlet and the sprayer mechanism.

21. The secondary container of claim 19 including a secondary check valve that permits contents of the secondary container to move only toward the mixing chamber of the dispensing pump.

22. The secondary container of claim 19 wherein the holding chamber has rigid side walls and an end wall spaced from the outlet, the end wall including a slidable seal adapted to slide within the side walls in contents-tight relation, whereby, as the contents of the holding chamber are pumped therefrom, the slidable seal slides toward the outlet, allowing the volume of the holding chamber to decrease and thereby to eliminate the need to venting the holding chamber.

23. The secondary container of claim 19 including a hollow, rigid shell and a collapsible, contents-tight liner contained within the shell and defining the holding chamber, the interior of the liner holding the contents of the secondary container and being in communication with the outlet, whereby, as the contents of the holding chamber are pumped therefrom, the liner collapses, decreasing in volume and eliminating the need to vent the holding chamber.

24. The secondary container of claim 19 wherein the holding chamber is rigid and is vented.

25. The secondary container of claim 19 including a secondary pumping means for pumping contents from the secondary container through the outlet, operating in physical coordination with the primary piston when the secondary container is attached to the body of the dispensing pump.

26. The secondary container of claim 25 having a a. holding chamber wall, b. a flexible membrane located in the holding chamber wall positioned to interact with means in the dispensing pump for flexing the membrane into and out of the holding chamber in physical coordination with the movement of the primary piston when the secondary container is attached to the secondary attachment means; and c. a one-way valved opening in the holding chamber wall allowing holding chamber contents to be pumped out through the valved opening and the holding chamber outlet toward the mixing chamber when the secondary container is so attached to the secondary attachment means and the membrane is flexed inwardly but preventing the contents from returning therethrough when the membrane is flexed outwardly.

27. The secondary container of claim 26 wherein the membrane is positioned to receive and be flexed by the movement of a piston extension rod that pushes against the membrane when the primary piston is moved.

28. The secondary container of claim 25 including a secondary piston and a secondary cylinder that, when the secondary container is attached to the secondary attachment means, is in communication with the holding chamber of the secondary container and the mixing chamber, with one-way valves permitting flow of holding chamber contents only toward the mixing chamber, the secondary piston being driven by means located in the dispensing pump to drive the secondary piston in physical coordination with the primary piston to pump contents from the holding chamber toward the mixing chamber.

29. The secondary container of claim 28 for use with the dispensing pump of claim 12 wherein the secondary piston is positioned to receive and be driven by the movement of the piston extension rod.

30. The secondary container of claim 28 wherein the means located in the dispensing pump to drive the secondary piston is adapted to move the secondary piston from a first position within the secondary cylinder toward a second position, the secondary container including a secondary spring that biases the secondary piston back toward the first position.

31. The secondary container of claim 19 containing a material to be mixed with fluid from the primary container by the dispensing pump.

32. The secondary container of claim 31 where the material is a fluid.

33. The secondary container of claim 31 where the material includes a pumpable, finely-divided solid.

34. The secondary container of claim 31 where the material includes an active ingredient selected from the group consisting of scents, cleaning active ingredients, biocides, and insect control active ingredients.

* * * * *